US005433483A

United States Patent [19]

Yu

[11] Patent Number: 5,433,483

[45] Date of Patent: Jul. 18, 1995

[54] CONSUMER-INITIATED, AUTOMATIC CLASSIFIED EXPENDITURE BANK CHECK SYSTEM

[76] Inventor: Mason K. Yu, 550 W. Brown, Suite #3, Birmingham, Mich. 48009

[21] Appl. No.: 146,450

[22] Filed: Nov. 1, 1993

[51] Int. Cl.[6] ..... B12D 15/00

[52] U.S. Cl. ..... 283/58; 283/57

[58] Field of Search ..... 283/57, 58, 59, 60.1, 283/60.2, 50, 63.1

[56] References Cited

U.S. PATENT DOCUMENTS

| | | | |
|---|---|---|---|
| 3,949,363 | 4/1976 | Holm | 340/146.3 D |
| 3,980,323 | 9/1976 | Boyreau | 283/57 |
| 4,346,917 | 8/1982 | Clancy | 283/58 |
| 4,400,017 | 8/1983 | Pendergrass | 283/66 A |
| 4,864,111 | 9/1989 | Cabili | 283/58 X |
| 4,958,066 | 9/1990 | Hedgcoth | 283/58 X |
| 4,974,878 | 12/1990 | Josephson | 283/67 |
| 5,016,919 | 5/1991 | Rotondo | 283/82 |
| 5,044,668 | 9/1991 | Wright | 283/58 |
| 5,121,945 | 6/1992 | Thomson et al. | 283/58 |
| 5,193,055 | 3/1993 | Brown et al. | 364/406 |

*Primary Examiner*—Willmon Fridie

*Attorney, Agent, or Firm*—Mason K. Yu, Jr.; Vivian Yu Lee; Gregory J. Yu

[57] ABSTRACT

This is a uniquely designed bank check which integrates the classification grid of expenditures for any household or business; whereupon the payer of the check initially marks only one applicable space from said grid; whereupon the payer's processor utilizes the image-captured, relevant information from the check; whereupon the payer's processor forwards said information, automatically produces a finalized financial report, and sends it to the payer of the check at the end of any monthly/annual check processing cycle.

8 Claims, 13 Drawing Sheets

75

Front Side

ACCOUNT NAME: JANE OR JOHN SMITH
ACCOUNT NO.: 045825010
STATEMENT PERIOD: OCTOBER 01 - 31, 1993
STATEMENT DATE: NOVEMBER 01, 1993

ABC BANK
456 MAPLE DRIVE
ANYTOWN, USA 10000
313-555-1000

| | |
|---|---|
| CLOTHING | 70.00 |
| CREDIT CARD | 35.00 |
| DONATIONS | 10.00 |
| EDUCATION | 20.00 |
| FOOD | 210.00 |
| HOUSING | 370.00 |
| INSURANCE | 5.00 |
| MEDICAL | 60.00 |
| RECREATION | 30.00 |
| TAXES | 100.00 |
| TRANSPORT | 55.00 |
| ELECTRIC | 30.00 |
| HEAT | 25.00 |
| PHONE | 20.00 |
| WATER | 15.00 |
| MISC | 50.00 |
| TOTAL | $1,105.00 |

ACCOUNT NAME: JANE OR JOHN SMITH
ACCOUNT NO.: 045825010
STATEMENT PERIOD: OCTOBER 01 - 31, 1993
STATEMENT DATE: NOVEMBER 01, 1993

ABC BANK
456 MAPLE DRIVE
ANYTOWN, USA 10000
313-555-1000

ACCOUNT NAME: XYZ CORPORATION
ACCOUNT NO.: 045825010
STATEMENT PERIOD: OCTOBER 01 - 31, 1993
STATEMENT DATE: NOVEMBER 01, 1993

ABC BANK
456 MAPLE DRIVE
ANYTOWN, USA 10000
313-555-1000

| | |
|---|---|
| ADS | 150.00 |
| CREDIT CARD | 325.00 |
| HEALTH | 200.00 |
| INSURANCE | 170.00 |
| IRA-401K | 100.00 |
| LEGAL | 50.00 |
| PURCHASE | 1,800.00 |
| RENT | 750.00 |
| TAXES | 450.00 |
| TRANSPORT | 100.00 |
| ELECTRIC | 110.00 |
| HEAT | 80.00 |
| PHONE | 70.00 |
| WATER | 30.00 |
| WAGES | 2,000.00 |
| MISC | 500.00 |
| TOTAL | $6,885.00 |

ACCOUNT NAME: XYZ CORPORATION
ACCOUNT NO.: 045825010
STATEMENT PERIOD: OCTOBER 01 - 31, 1993
STATEMENT DATE: NOVEMBER 01, 1993

ABC BANK
456 MAPLE DRIVE
ANYTOWN, USA 10000
313-555-1000

CONSUMER-INITIATED, AUTOMATIC CLASSIFIED EXPENDITURE BANK CHECK SYSTEM

FIELD OF THE INVENTION

The field of invention relates to the automatic processing of any handwritten or computer-generated bank check for classification of its expenditures through the banking system.

GLOSSARY OF TERMS

Bank is a financial institution which includes a local bank, state-chartered bank, national bank, Federal Reserve Bank, thrift institution, savings association, credit union association, or any other institution which processes checks.

Bar Code is a system of alternating black and white bars which form a code which is readable by a machine or computer.

Check is a written document in the form of a draft, money order or other negotiable instrument processed by a bank.

Drawee Bank is the bank on which is check is drawn.

Human Language is any recognized written human language, including without limitation, all languages within the Indo-European family of languages, the family of ancient Semitic languages, and the major pan-Asiatic family of languages.

Icon is a method of identifying and classifying a disbursement through the use of pictographic images—designed by human or computerized means—on the Payer's bank check for accounting, budgeting, tax or other purposes.

MICR is a process known as magnetic ink character recognition by a machine or computer.

MRS is any machine readable system which uses and scans characters and/or images on a document and includes MICR, OCR, Bar Code, International Business Machine's [IBM] Courtesy Amount Read Technology, and all other derivatives thereof hereinbefore, or now in existence, or in the future.

OCR is a process known as optical character recognition by a machine or computer.

PI is positional indexing, a system of computerized or mechanized optical scanning based upon the exact distance from the beginning of a designated MICR code to the end of a designated MICR code within any region of a check.

Payee is an individual or named entity to whom the check is made payable.

Payee Processor, either the bank or data processing servicer which processes the check for the payee.

Payer is an individual or entity which is the writer of the check.

Payer Processor, either the bank or data processing servicer which processes the check for the payer to generate a statement of periodic activity from the payer's bank account.

Region is any portion of the check which contains the following heuristic combination of: MRM code, PI systematic code, and the classification grid of expenditures in any human language and/or pictographic icons for use by the present invention.

DESCRIPTION OF PRIOR ART

The use of any machine readable system (MRS) which includes characters or images imprinted upon checks is known in prior art. Automated processing of such characters or images on any document: containing financial data for budgeting, bookkeeping, accounting, tax, and other related purposes is also known in prior art. However, such methodologies have never been combined or used within the banking system automatically to meet the categorization of expense disbursements according to the payer's checks.

U.S. Pat. No. 3,949,363 to Holm (1976) sets forth a redundant character recognition system for automatic sorting of documents encoded with both MICR alphanumeric characters and machine readable bar codes.

U.S. Pat. No. 3,980,323 to Boyreau (1976) sets forth a system for manually preparing and preserving tax records by manually crossing out a numbered box whose expense category is referenced on a separate check register.

U.S. Pat. No. 4,346,917 to Clancy (1982) sets forth a manually prepared, checkbook register and account record journal system.

U.S. Pat. No. 4,400,017 to Pendergrass (1983) sets forth a manually prepared, monthly checkbook register for recording budget items and accounting data system.

U.S. Pat. No. 4,974,878 to Josephson (1990) sets forth a single payment coupon system which becomes a multi-functional document: a pre-authorized bank draft initiated by the payee rather than the payer; a negotiable instrument, namely the bank draft; and thus creating a complete audit trail and accounting of such.

U.S. Pat. No. 5,016,919 to Rotondo (1991) sets forth a negotiable instrument (bank check) highlighting adjacent, dual magnetic strips of identical backup data.

U.S. Pat. No. 5,044,668 to Wright (1991) sets forth a bank check comprising of one MICR-encoded, magnetic strip or bar code of account information to be read for immediate approval or rejection at the sales transaction.

U.S. Pat. No. 5,121,945 to Thomson and Josephson (1992) sets forth a system whereby the payee and vendor creates an integrated document which includes an accounts receivable invoice and a preprinted payer's check containing one or more MRS codes.

U.S. Pat. No. 5,193,055 to Brown and Scherer (1993) sets forth an accounting system using a pre-established category codes and the entry of data by the customer to be further processed through a service company.

BACKGROUND OF THE INVENTION

Existing art provides little or no facility for the payer to categorize or classify an expenditure on the physical payment media—a personal check, a bank draft, or postal money order. Through a manual handwritten means or a computer-generated system, payments by the payer are classified for tax, accounting, statistical, or budgeting purposes during the transaction point (the Transaction) or at a time thereafter. Obviously for the consumer, expenditures cover food, transportation, housing, utilities and other sundries. For the small business, they cover rent, salaries, supplies, inventory, and any other items for operating the enterprise.

If the payer uses an automated payment system at the Transaction, payments are easily classified through standardized or customized check writing, accounting and tax software. However, many individuals and small businesses cannot use this system for practical or economic reasons. It is simply not feasible to transport a computerized check system for the Transaction to every place where cash is disbursed—at the restaurant, department store, gas station, grocery store, or elsewhere.

Without an automated system, the payer must later classify payments with either a manual or a computer system. The payer with only a manual system often will make a handwritten memorandum which must be read and recorded into another record-keeping system. Without this handwritten memorandum, the payer is left with three means to later classify the expenditure: human memory; the name of the payee and perhaps a note on the Memorandum Line of the check; a source document cross-referenced and/or attached to the check itself. This undaunting task can fall into the hands of an accountant, a bookkeeper, or outside tax preparer who all have had no direct participation during the Transaction. Even the payer who has an automated system may input the payment information into another automated computer data processing system.

These two methods are flawed, because they absorb an undue amount of time and resources to properly record and classify each Transaction. The first one, which is purely manual, suffers from inefficiency and human error. The second one is duplicative. Every data processing system, no matter how advanced, requires at least one initial entry of data. The payer wastes valuable time and resources whenever he must re-input the payment data for each Transaction.

Prior art boasts an abundance of automated procedures and systems for the payer. In fact, high technology which now includes debit cards and other automatic payment mechanisms, appears to promise us the inevitable—the checkless society. However, the payer cannot escape the need (and indeed the burden) to fully document any Transaction for tax-reporting purposes. Aside from being driven by fear of an IRS audit, the consumer or small business benefits from tracing and tallying the expenditures in the most cost effective manner. Most of all, it is human nature in a capitalist society to obtain some form of receipt no matter what the expenditure is, usually, the cancelled check.

Contrary to expectations in some quarters, the number of checks processed annually has escalated from 38 billion to 60 billion during the last ten years. If anything, the technology has necessitated the even greater demand for speed and accuracy in check processing. For example, U.S. Pat. No. 5,016,919 issued to Rotondo (1991) provides for the placement of a second magnetic strip along the check's right side containing the same information as the bottom MICR-encoded one. This supposedly increases the accuracy of check processing by a bank. The hardware for check processing continues to enhance the speed and accuracy of this procedure. The IBM 3890 Reader/Sorter can process hundreds of checks per minute; furthermore, IBM even now has a new technology called Courtesy Amount Read which revolutionizes processing speed and accuracy by capturing the total image with an optical scanner.

Population alone does not account for the rise in checks issued, although the number of family units in the U.S. now exceeds 91,000,000. With the rising number of single and divorced household units, one can only expect more checking accounts and checks being processed. On the business side, the 1991 tax year generated over 20,000,000 business tax returns (corporate, partnership, and sole proprietorship) filed with the IRS. With more corporate downsizing and more workers voluntarily and involuntarily choosing career alternatives—outside consulting and contractual assignments—there will be more tax returns. Economics and demographics support this trend.

Now more than ever, family households and small businesses must closely monitor monthly expenditures. Up until now, no system has directly bridged the technology of bank check processing and the payer's need to classify expenditures.

U.S. Pat. No. 3,980,323 to Boyreau (1976) describes a manual system of classifying expenditures for tax purposes with a physical mark on the face of the check, but without the benefit of the bank's internal data processing.

U.S. Pat. Nos. 4,346,917 and 4,400,017 to Clancy and Pendergrass [1982 and 1983, respectively] also describe other purely manual systems of classifying check expenditures and budget entries. But again, these two manual systems do so without the benefit of the financial institution's computerized data processing.

U.S. Pat. No. 3,949,363 to Holm (1976) merges various MRS systems into a single stream of data to expedite check processing. The payer, however, neither creates these codes nor directly benefit from this process.

U.S. Pat. No. 5,044,668 to Wright (1991) utilizes the bar code or MICR-encoded magnetic strip of account information on the bank check. But the payee of the check, not the payer, benefits from this check processing—immediate approval or rejection at the Transaction.

U.S. Pat. No. 4,974,878 to Josephson (1990) describes a single payment coupon system: a multi-funtional set of documents encompassing a pre-authorized draft and a negotiable instrument. But this system can complicate the accounting procedures for the payer when he uses the payee's pre-printed check. The payer has no immediate record in his checkbook register; consequently, he can risk overdrawing his account!

U.S. Pat. No. 5,121,945 to Thomson and Josephson (1992) seeks to streamline transaction procedures for the payee and payer. It also describes another format of pre-printed, integrated Accounts Receivable notice and bank check, relatively similar to the aforementioned reference. But again, the payee pre-arranges and controls the check payment process to his advantage, not to the payer.

Finally, U.S. Pat. No. 5,193,055 to Brown and Scherer (1993) is an accounting system for the family household and small business. This overall system of data processing for accounting purposes limited advantages here. The payer must rely on a storage medium other than the check itself to recall and record various numeric codes assigned to pre-classified expenditures. More specifically, this system imposes these additional burdens on:

(1) the payer with an automated system of check writing and accounting, it forces the payer after the checks have been processed by the bank to read the cancelled checks at another off-site location; or (2) the payer with a high volume of manual check writing, it may necessitate purchasing an accounting software package or employing an outside accountant to prepare a suitable chart of accounts; or finally, (3) the payer with a low volume of manual check writing, it may simply lack the economic justification.

EMBODIMENT OF THE INVENTION AND THE UNIQUE ADVANCEMENT FROM PRIOR ART

The present invention, a uniquely designed bank check, is a novel combination of features under existing and developing informational processing technologies. It is distinguishable from all prior art, because this combination of very useful functions create a means of documenting and classifying expenditures through the present banking system. The present invention and its unique features utilize all known computer hardware/-software/firmware, computer graphics, computer databases, computer data communications, and data transmissions systems. Collectively, the aforementioned computerized technologies benefit all consumers, whenever they utilize the present invention.

Moreover, financial institutions have the potential, aggregate, computational power of a trillion instructions per second. They also have invested in hardware, software and Management Information Systems [MIS] support staff of no less than the combined Gross National Product [GNP] of several third-world countries.

The present invention harnesses all that power, speed, and technology of bank check processing for the payer's benefit, no matter what size and type. By simply using the present invention, the payer can request his financial information of classified expenditures through any telecommunications systems from his drawee bank or payer processor. Further, his financial institution by also, using the same invention can automatically prepare and present to the consumer such uniquely formatted information along with his standard monthly statement of accounts.

Figure 1:
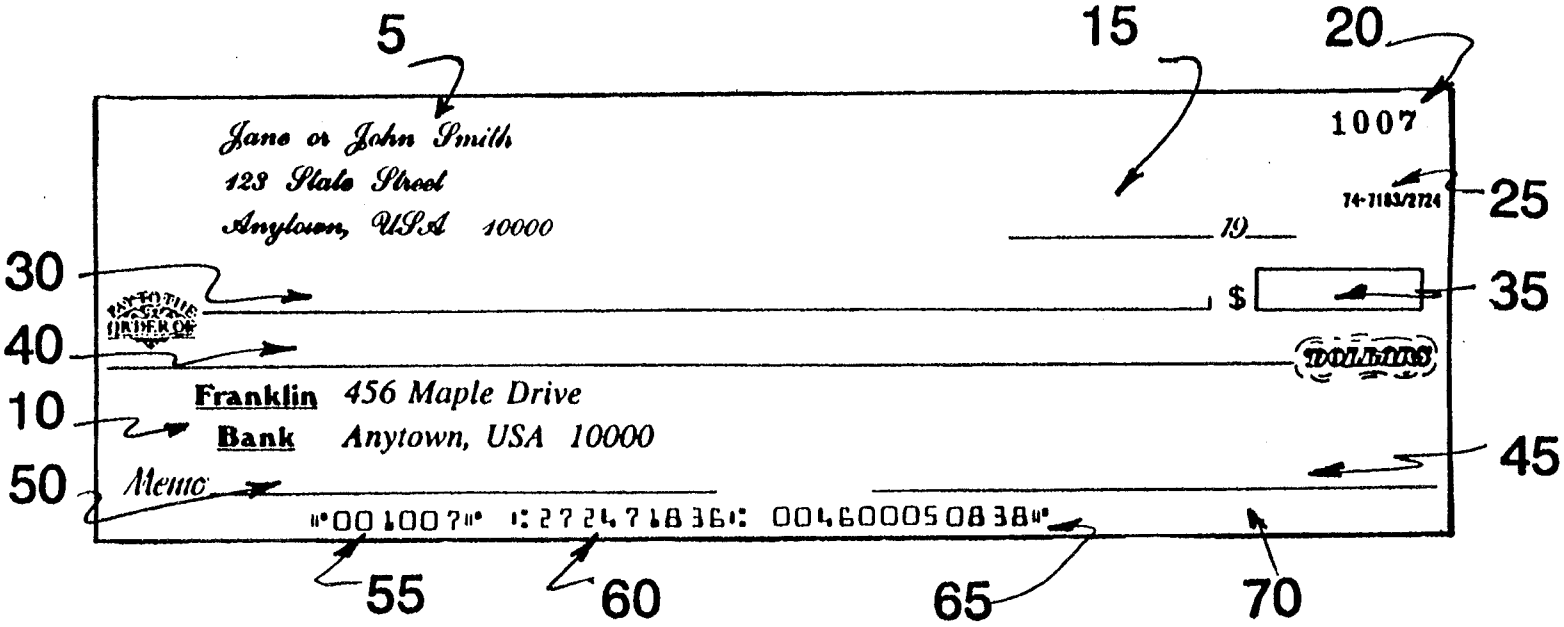
FIG. 1 illustrates the form of a regular bank check.

The check shown as FIG. 1 contains the standard information on a personalized bank check. There is:

- the full name and address of the payer (5);
- the drawee bank's name and address (10);
- the date the check is written (15);
- the sequential check or reference number (20);
- the fractional form of the drawee bank's transit/routing number (25);
- the line on which the payee's name is entered (30);
- the check amount in Arabic numerals (35);
- the check amount in words (40);
- the line on which on the payer's nonfraudulent signature is affixed (45); and
- the Memorandum Line which permits additional information about the expense (50).

The same bank check also sets forth certain numeric information in MICR code along the bottom edge:

- the sequential check or reference number (55);
- the drawee bank's transit/routing number (60);
- the payer's bank account number (65); and
- the check amount in MICR code which the payer processor imprints during check processing (70).

Figure 2:
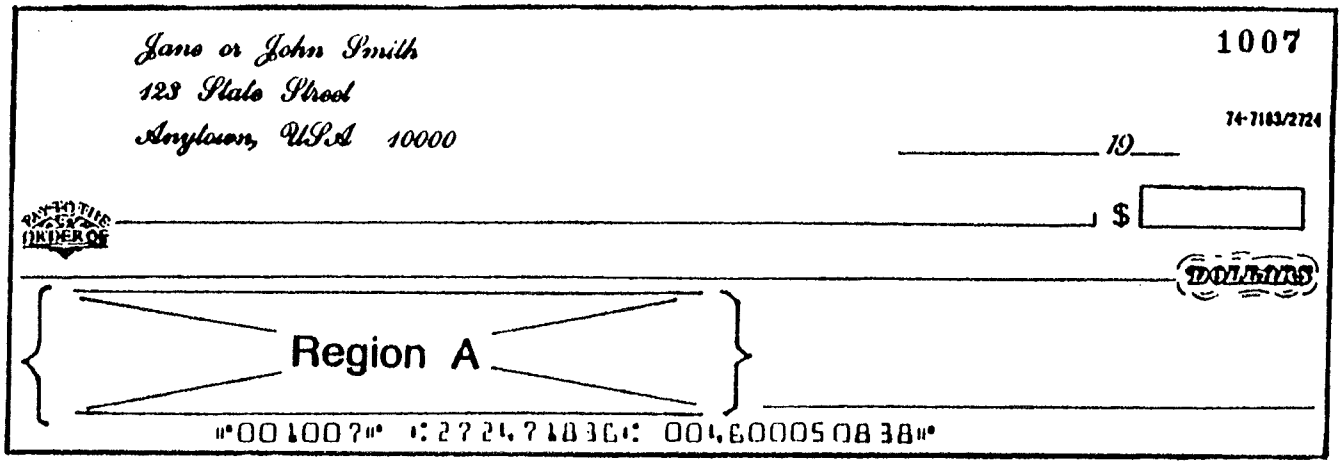
FIG. 2 illustrates the form of a bank check of the present invention with Region A identified.
Figure 3:
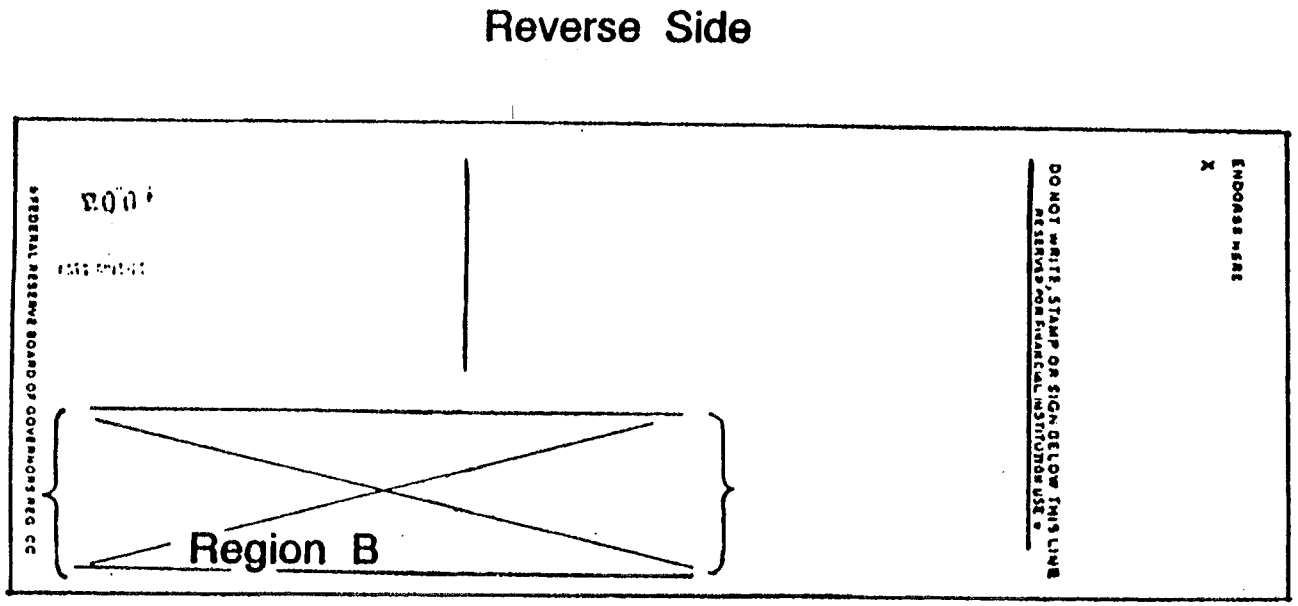
FIG. 3 illustrates the form of a bank check of the present invention with Region B identified.

The check in the present invention allocates the classification grid of expenditures in: either Region A [front side, lower left-hand corner where the Memorandum Line is currently located] as shown in FIG. 2; or Region B [back side, lower left-hand corner] for said grid as shown in FIG. 3. Nevertheless, either Region A or Region B of the check will contain said grid.

Figure 4:
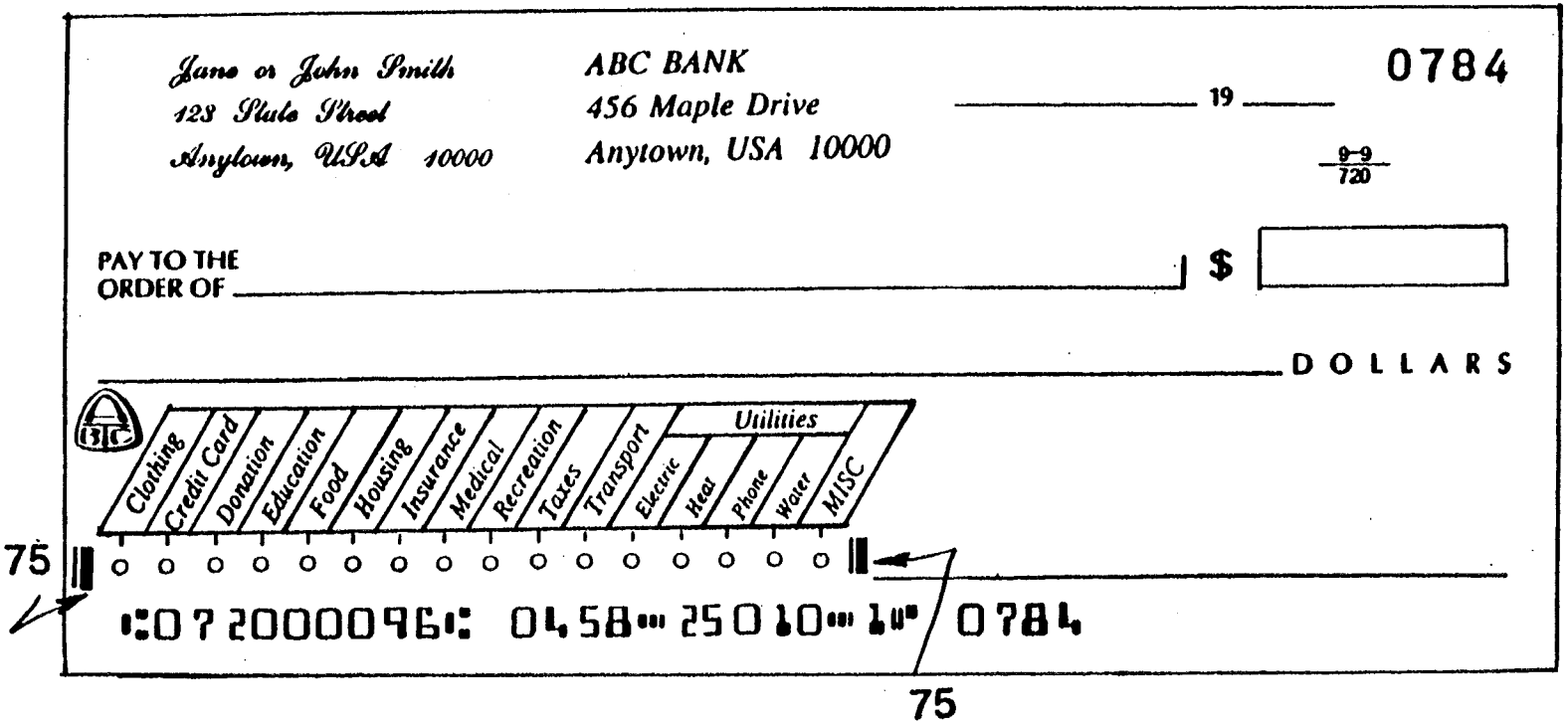
FIG. 4 shows the classification template on the check (with leading and trailing markers in MICR code) for household expenditures in human language form.
Figure 5:
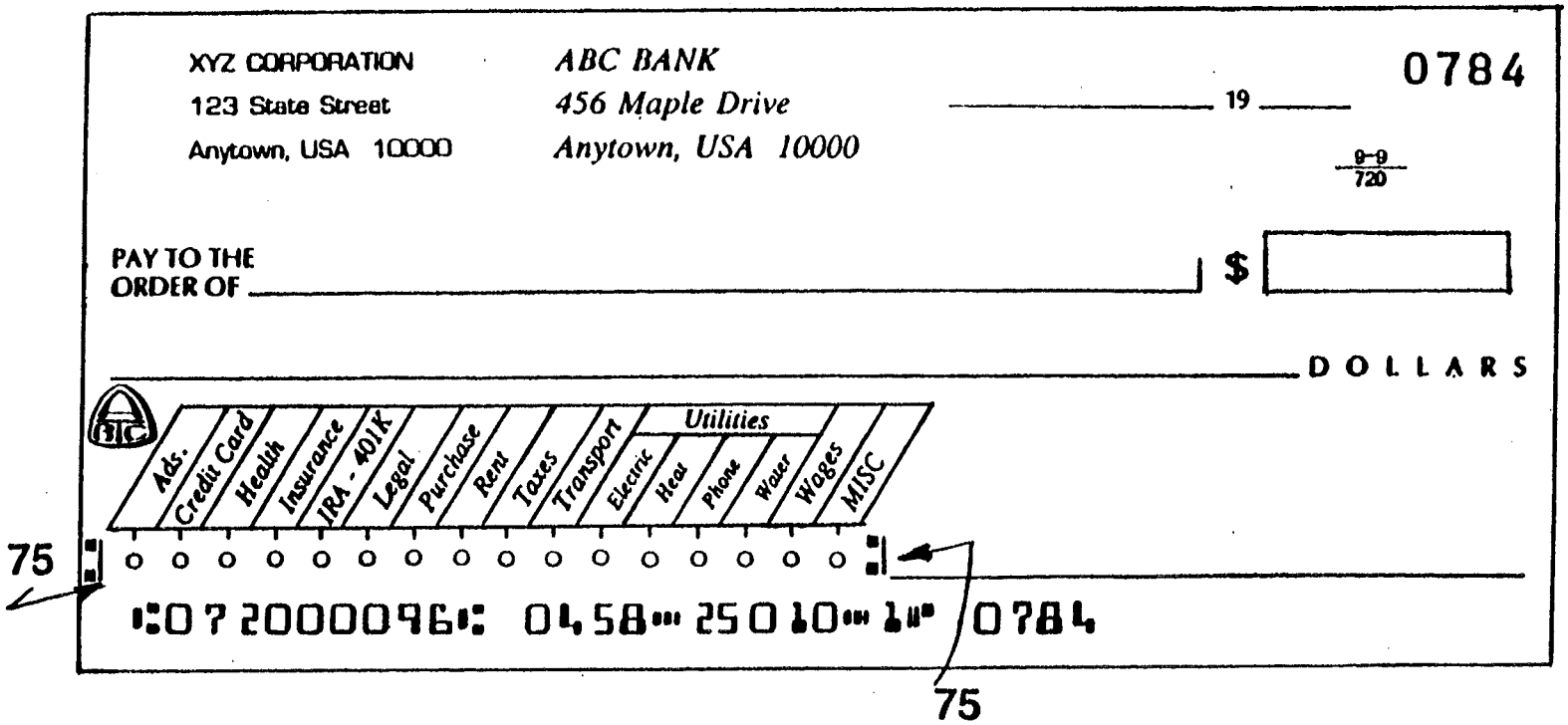
FIG. 5 shows the classification template on the check (with leading and trailing markers in MICR code) for business expenditures in human language form.

The present invention offers four templates containing the classification grid of expenditures, with no less than five (5) categories and appropriate spaces. FIG. 4 is the classification template for household expenses in any recognized, written human language. FIG. 5 is the classification template for business purposes also in any recognized, written human language.

Figure 6:
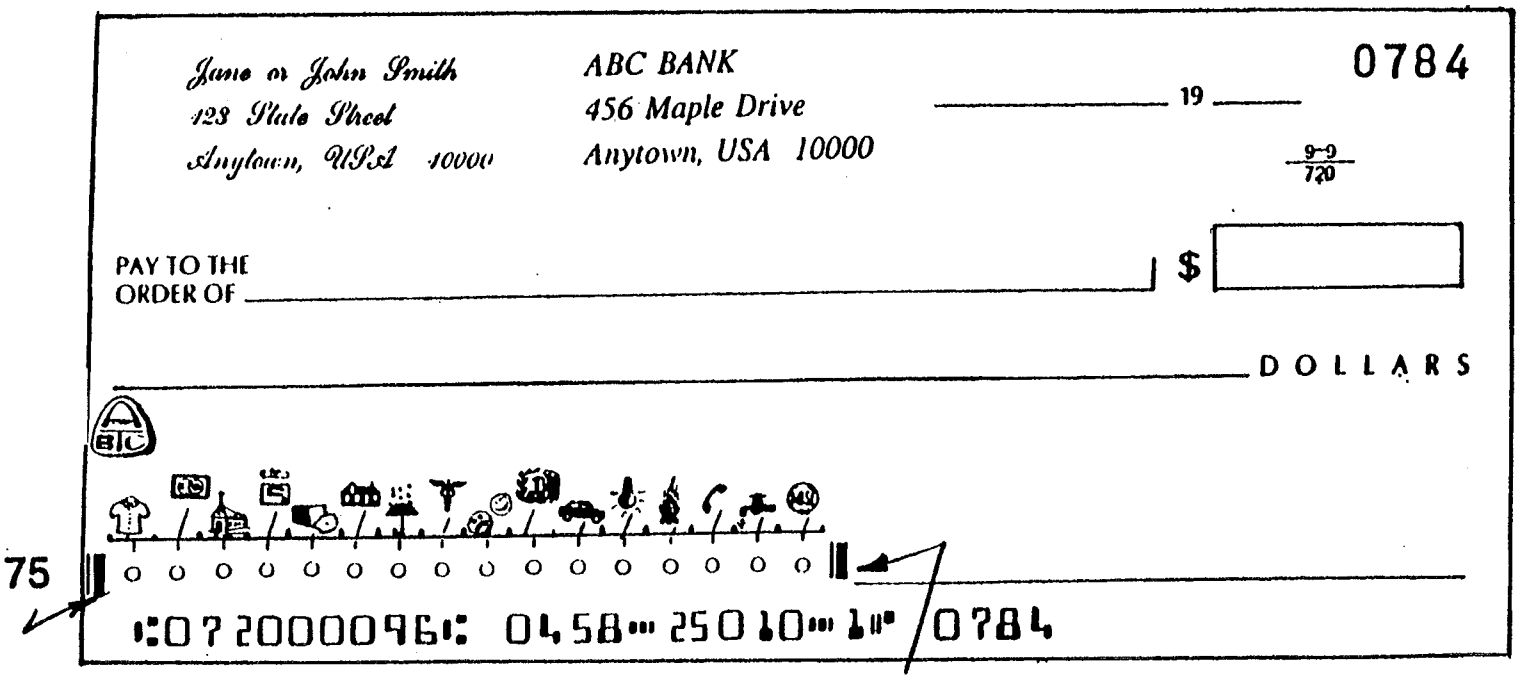
FIG. 6 shows the classification template on the check (with leading and trailing markers in MICR code) for household expenditures in pictographic icon form.
Figure 7:
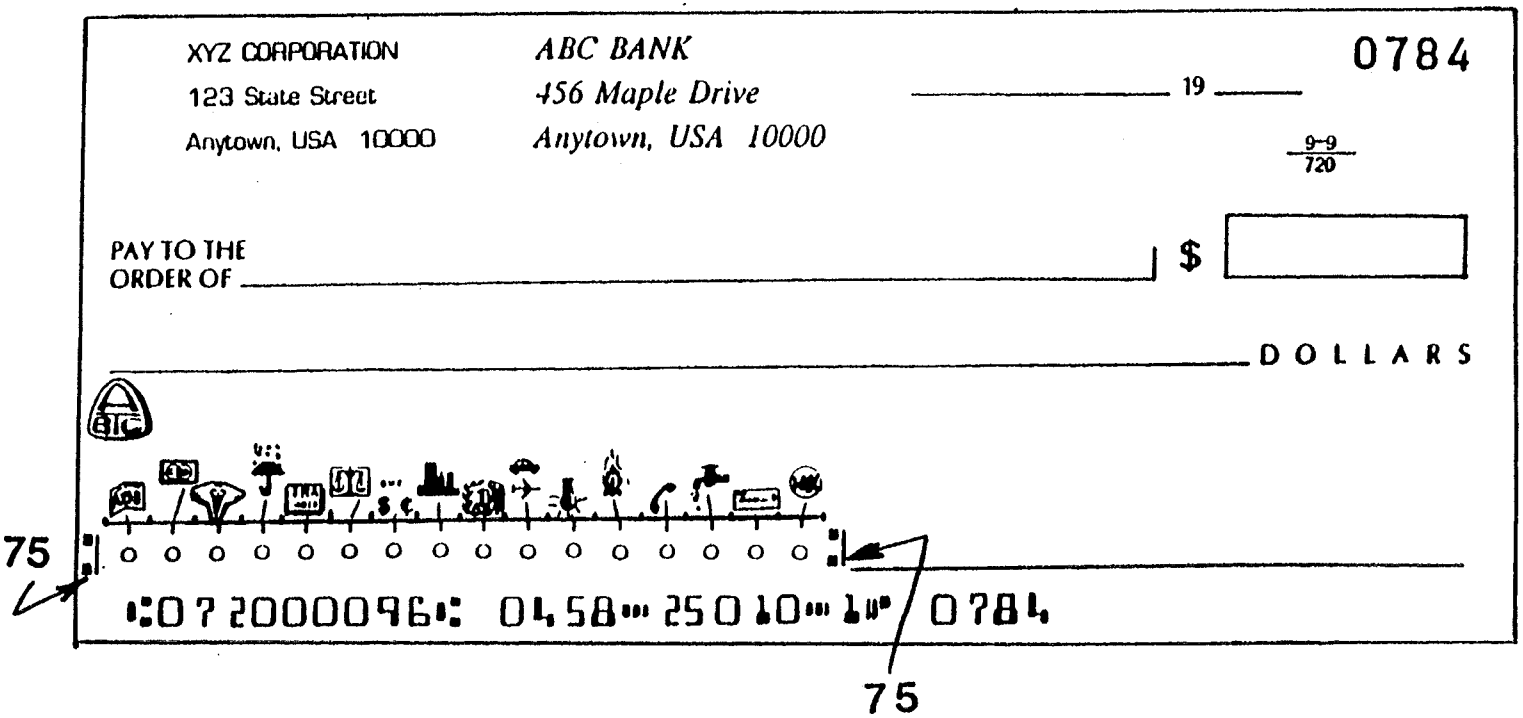
FIG. 7 shows the classification template on the check (with leading and trailing markers in MICR code) for business expenditures in pictographic icon form.

Further, the present invention also provides a new methodology of classifying expenditures by a series of pictographic icons (Icons) designed by human or computerized means. Each Icon correlates to a particular classification expenditure and appears above its special space. FIG. 6 sets forth the standard template for household expenses pictographic icon form; and FIG. 7 sets forth the standard template for business expenses in pictographic icon form.

The present invention—classified expenditure templates and its location at either Region A or Region B—as integrated into the bank check will comply with the industry standards in the American Bankers Association Publication 147R3 The Common Machine Language.

At the Transaction, the payer while writing the check can easily classify the expenditure by marking one of the special spaces. The proper writing instrument is a non-erasable, thin marker or ink pen.

Figure 8:
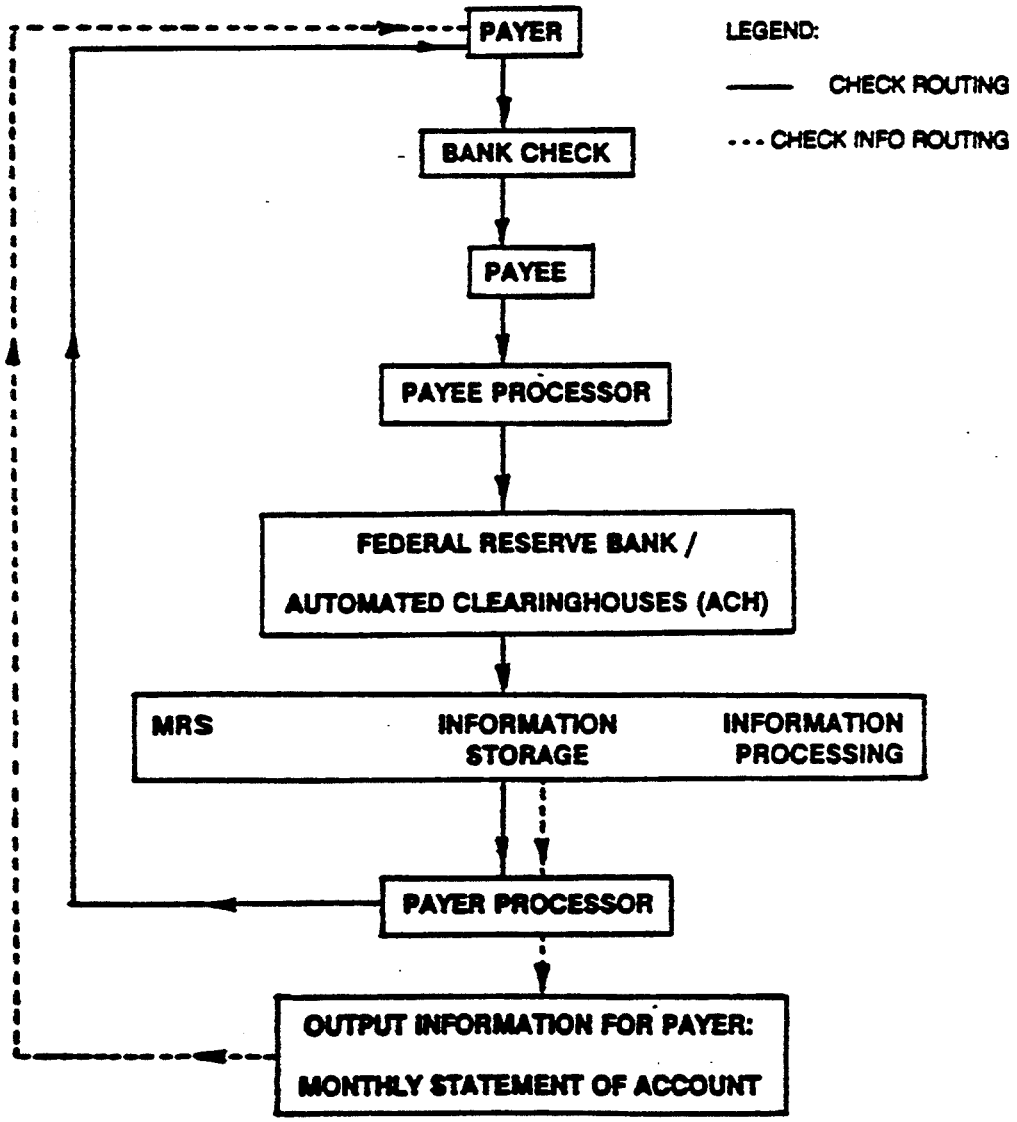
FIG. 8 is a detailed flowchart of bank check processing under the present system.

In prior art, after the payee processor imprints the amount of the check in MICR code along the bottom right edge of the check and his check reader/sorter scans such information, the payer processor receives the check for further processing—debiting the bank account of the payer for the amount of the check. During a one month period, the checks debited against the payer's account are batched and sorted. At the end of said period, the payer processor sends to the payer that month's cancelled checks and statement of activity. For further details of bank check processing system under the present invention, please see FIG. 8.

Through the present invention, it specifically provides for the informational image/optical scanning of various classified expenditures from either Region A or Region B of the check by the payee processor.

As a suggested method of image/optical scanning the classification grid of expenditures the payee processor—by means of a check processing reader/sorter adapted with an additional image/optical scanning device (the Modified Check Processor)—can employ the PI (positional indexing) system.

Under the present invention, this Modified Check Processor scans either Region A or Region B of the negotiable instrument: more specifically, it can scan the marked space by the payer between the leading marker and the trailing marker in either Region. Please note the leading markers in MICR code (75) and trailing markers also in MICR code (75) as indicated in FIG. 4, FIG. 5, FIG. 6, and FIG. 7.

For example, if the payer of the check marks the fifth unit space in either Region, the Modified Check Processor under the PI system will be able to read that the fifth unit space from the leading marker automatically correlates to the IRA–401K classified category under business expenditures in human language/pictographic icon formats; and to the FOOD classified category under household expenditures in likewise formats. Please see FIG. 4 and FIG. 5.

However, in the unlikely event the payer of the check does not mark any unit space in either Region A or Region B, then the Modified Check Processor under the PI system will automatically select the MISCELLANEOUS classified category, the identical unit space for both business and household checking accounts.

Figure 9:
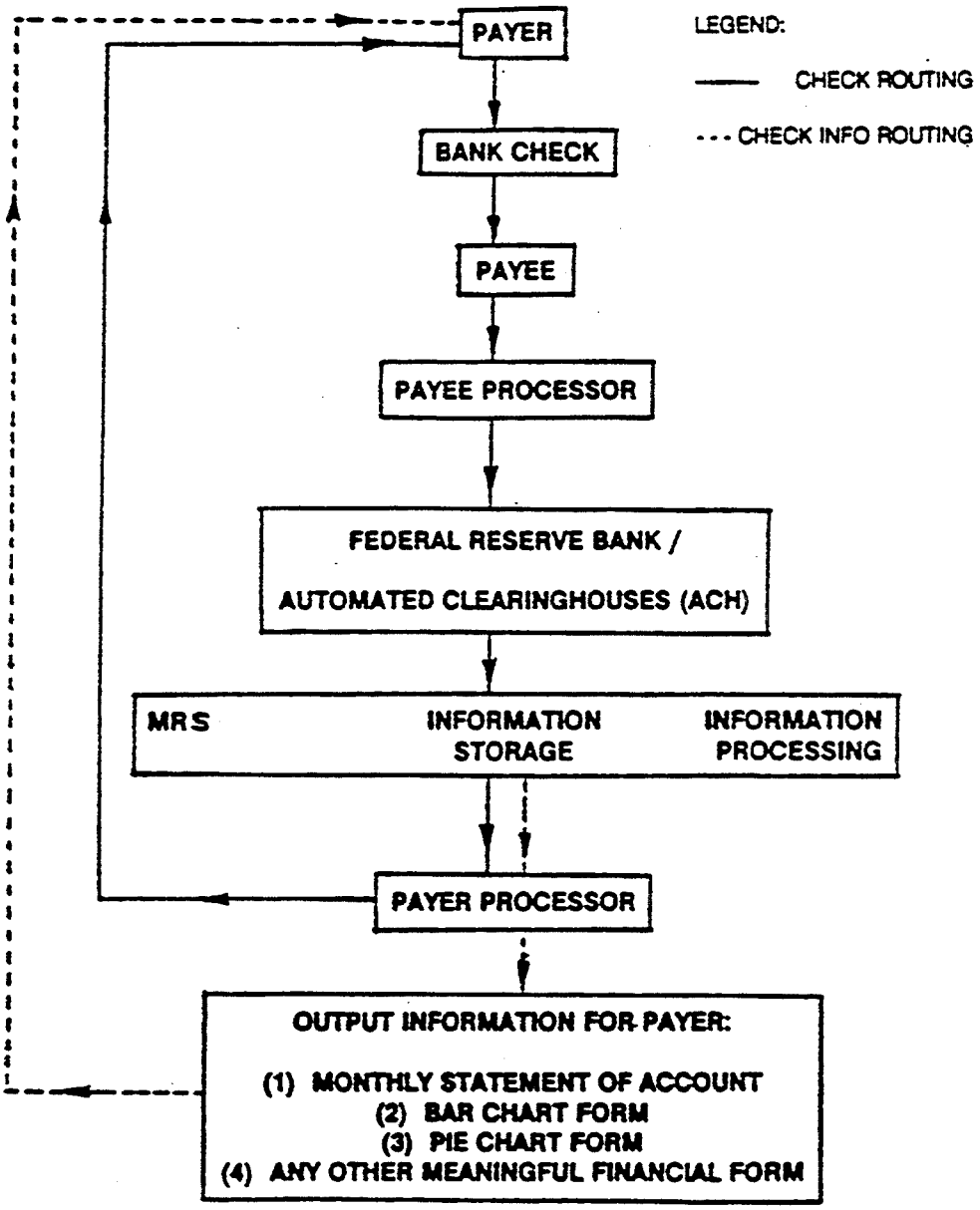
FIG. 9 is a detailed flowchart of bank check processing under the patented system.

Then, the payer processor performs a series of calculations—by processing and utilizing this optically scanned information—which results in a continuous, up-to-date summation of each classified expenditure. Under the present invention, not only can the payer request from his payer processor a current balance on his checking account, but also he can request a current total of each classified expenditure through any telecommunications method. For details of bank check processing under the present invention, please see FIG. 9.

Figure 10:
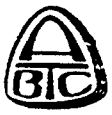
FIG. 10 is output information in a bar chart form which illustrates the absolute dollars of household expenditures.
Figure 11:
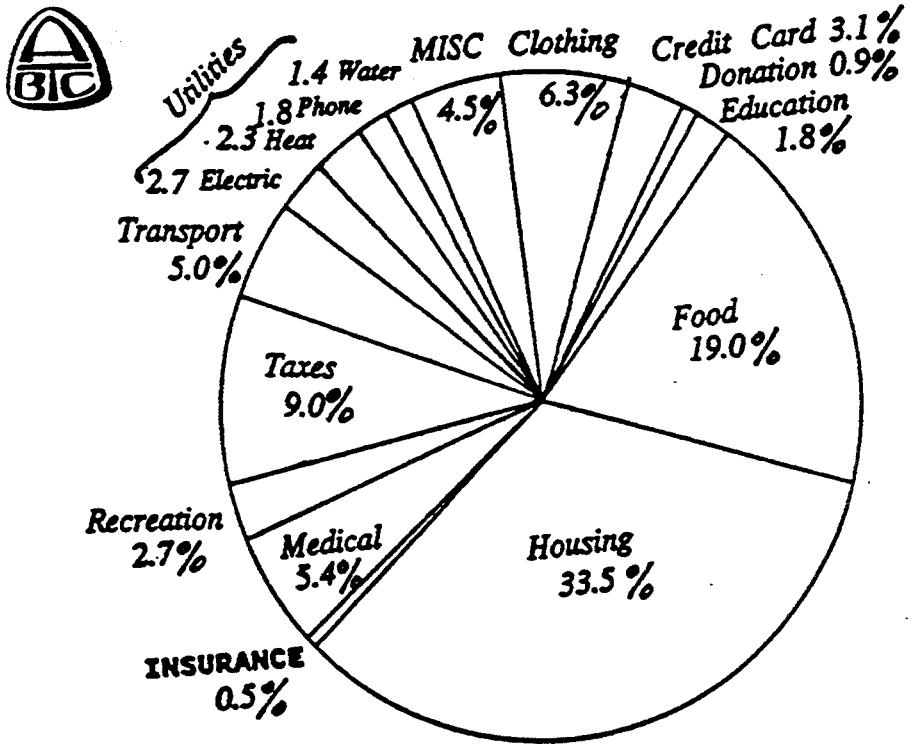
FIG. 11 is output information in a pie chart form which illustrates the relative percentages of household expenditures.
Figure 12:
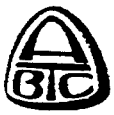
FIG. 12 is output information in a bar chart form which illustrates the absolute dollars of business expenditures.
Figure 13:
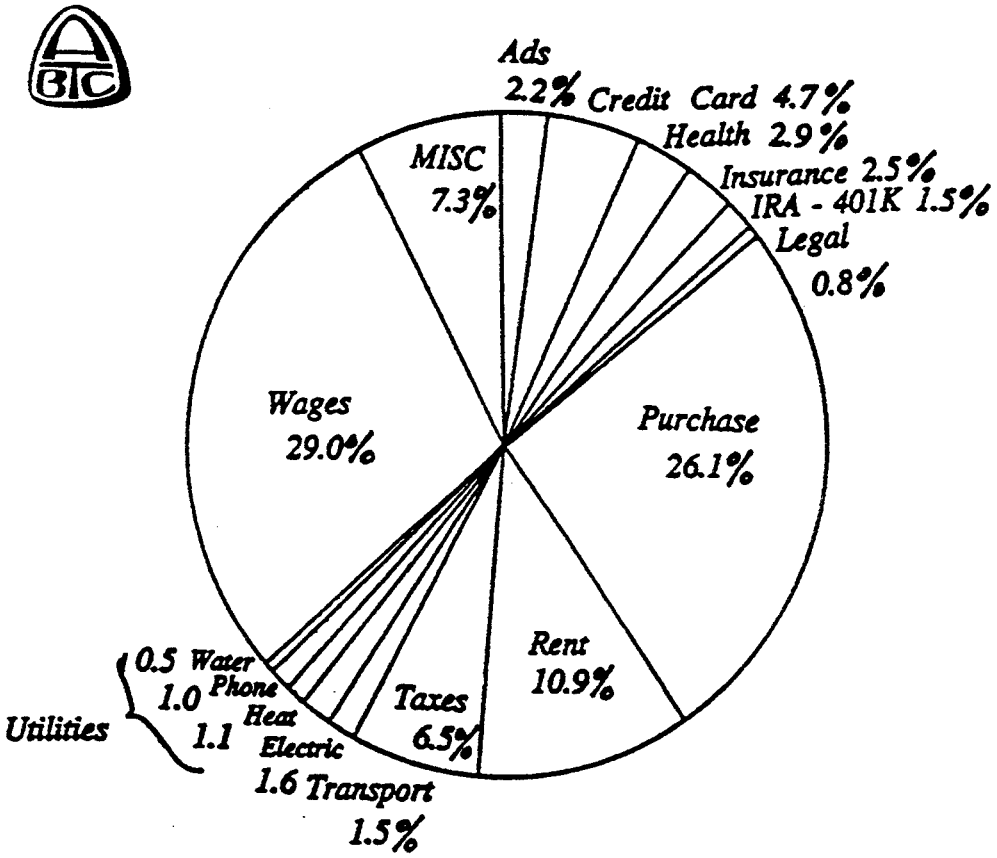
FIG. 13 is output information in a pie chart form which illustrates the relative percentages of business expenditures.

Furthermore, each classified expenditure from this informational database can be automatically generated by the payer processor into a monthly statement of checking account activity and a series of useful, output informational documents: bar chart forms; pie chart forms; and even statistical tables. Please see FIG. 10 and FIG. 11 for the household expenditures; FIG. 12 and FIG. 13 for the business expenditures.

ADVANTAGES OF THE PRESENT INVENTION

Responsible financial reporting has three key elements—timeliness, accuracy, and cost effectiveness. Many existing financial and accounting reporting systems, whether manual or automated, sacrifice one element for another. Worse yet, a system might be deficient on all counts.

The present invention simply and inexpensively allows any checking account holder to classify all expense disbursements at the time and place of Transaction, in one easy step. The payer of the check merely marks a designated space—at either Region A on the front side of the check or Region B on the reverse side of the check—to classify the expenditure. Once the payer reads and marks one classification space on the check (either human language or pictographic icon form), the bank processing system does the rest automatically.

Each household or each business faces the same issues over the use of money: first, the exact amounts that were spent during a prior period; and second, the purposes of those amounts spent. Instead of the payer guessing weeks and months later what the disbursement purpose was, the present invention provides classification of such expenses just as soon as the checks are processed in the banking system. Any household or business will be able:

(1) to have a report card of financial expenditures for the prior period; and/or (2) to quickly retrieve such information through any telecommunications system.

Moreover, every household and small business is reluctant to pay for a computer banking or accounting system which may have nominal value. To the contrary, the present invention truly saves time, money, and energy in the classification of expenditures. Just a simple mark in the applicable space by manual or computerized means initiates the automatic classification of expenses and obviates a tedious note on the Memorandum Line of the check.

Individuals and businesses benefit immeasurably. Budgets can be easily prepared with greater accuracy. The user of the present invention can now have an accurate and timely summary of expenditures. Collectively, they can dispense with both overly sophisticated, complex, and user-unfriendly computer systems and arcane, cumbersome, and inaccurate manual systems.

And furthermore, tax deductible expenditures will be clearly denoted with each check whenever it is intended to do so. The classification will be decided at the Transaction when the expenditure occurs. No longer will the taxpayer need to reach into the depths of his memory or imagination to capture the tax deductible entitlement. Indeed, with proper professional advice, the taxpayer will be prepared to immediately classify deductible expenditures.

Statistical analyses of a new dimension will abound. With the classification of expenditures made by households and businesses through the present invention, banks will have key comprehensive data to furnish the government and economists alike. This data measures the purchasing power and proclivities of the general populace and businesses.

This invention presents the ultimate answer and advantage for every consumer and business.

Final note: while embodiments of the present invention have been shown and described, various modifications may be made without departing from the spirit and scope of the present invention; and all such modifications and equivalents are intended to be covered. Therefore, the entire scope of the present invention should be determined by the appended claims and their legal equivalents, rather than by the given examples.

I claim:

1. A bank check comprising a paper slip having a front face imprinted with the name of an account holder and financial institution, a machine readable financial institution transit/routing number, account number identification, and check reference number, and blank lines for a date, payee designation, check amount, and check drawer signature, respectively;

an array of demarcated blank spaces imprinted on a region of said check;

a labeling imprint adjacent to each blank space;

each labeling imprint designating an expenditure category distinct from those designated by the other labeling imprints adjacent to the other blank spaces;

whereby the check drawer can mark the blank space adjacent to the appropriate labeling imprint corresponding to the expenditure category transacted by the drawing of the check at the time said check is drawn;

said blank space marking comprising information which can be collected and processed by said financial institution.

2. The check according to claim 1 wherein said labeling imprints comprised of descriptive text imprints.

3. The check according to claim 1 wherein said labeling imprints comprised of descriptive pictographic imprints.

4. The check according to claim 1 wherein one of said labeling imprints includes a Miscellaneous designation.

5. The check according to claim 1 wherein said array of demarcated blank spaces is located on the front side, lower left region; wherein said array is above and parallel to the MICR encoding; wherein said array is to the left of the blank line for the check drawer signature.

6. The check according to claim 1 wherein said array of demarcated blank spaces can be also located on the back side, lower left region.

7. The check according to claim 1 wherein said labeling imprints each describe a category of household expenditures.

8. The check according to claim 1 wherein said labeling imprints each describe a category of business expenditures.

* * * * *